US010151309B2

(12) United States Patent
McIntyre

(10) Patent No.: US 10,151,309 B2
(45) Date of Patent: Dec. 11, 2018

(54) PERISTALTIC PUMP

(71) Applicant: John McIntyre, Traverse City, MI (US)

(72) Inventor: John McIntyre, Traverse City, MI (US)

( * ) Notice: Subject to any disclaimer, the term of this patent is extended or adjusted under 35 U.S.C. 154(b) by 328 days.

(21) Appl. No.: 15/160,093

(22) Filed: May 20, 2016

(65) Prior Publication Data

US 2017/0268496 A1 Sep. 21, 2017

Related U.S. Application Data

(63) Continuation of application No. 15/075,617, filed on Mar. 21, 2016, now abandoned.

(51) Int. Cl.
*F04B 43/12* (2006.01)
*F04B 45/08* (2006.01)

(52) U.S. Cl.
CPC ..... *F04B 43/1238* (2013.01); *F04B 43/1253* (2013.01); *F04B 43/1261* (2013.01); *F04B 45/08* (2013.01)

(58) Field of Classification Search
CPC ... F04B 43/1238; F04B 45/08; F04B 43/1253
USPC ..... 417/477.1
See application file for complete search history.

(56) References Cited

U.S. PATENT DOCUMENTS 4,518,327 A * 5/1985 Hackman ..... F04B 43/1253 417/477.3
4,705,464 A * 11/1987 Arimond ..... F04B 43/1276 417/477.12
6,494,692 B1 12/2002 Green
7,478,999 B2 1/2009 Limoges
2007/0104599 A1* 5/2007 Michels ..... F04B 43/1253 417/477.1
2008/0231654 A1* 9/2008 Watanabe ..... B41J 2/16532 347/30

FOREIGN PATENT DOCUMENTS

FR 1562957 * 4/1969
GB 2211557 A * 5/1989

* cited by examiner

*Primary Examiner* — Charles G Freay

(57) ABSTRACT

A peristaltic pump device includes a resilient tube secured in a pump housing with a rotor having rollers squeezing against the resilient tube facilitating the pumping of a liquid or gas. A cylindrical rotor rotates in a bore provided in the pump housing. The rotor has steps in which rollers freely slide and rotate. As the rotor rotates, the rollers also rotate and are slidingly held in the rotor step thereby frictional contact with the compressing resilient tube and consequently the liquid or gas within goes out of the resilient tube. The pump is inexpensive to build, reliable, and by design promotes the long life of the resilient tube as compared to existing roller type peristaltic pumps.

1 Claim, 6 Drawing Sheets

PERISTALTIC PUMP

CROSS-REFERENCE TO RELATED APPLICATIONS

This Continuation-In-Part application claims the benefit of U.S. patent application Ser. No. 15/075,617 filed Mar. 21, 2016.

FIELD OF THE INVENTION

The invention is in the field of pumps, and more particularly peristaltic pumps of the rotary type having rollers to facilitate a flow of liquids or gases through a resilient tube.

BACKGROUND OF THE INVENTION AND DESCRIPTION OF RELATED ART

The term "peristaltic pump" is used herein to describe a type of positive displacement pump for pumping liquids, gas, or combination thereof. The most common peristaltic pumps utilize a pump housing having a rotating rotor with rollers attached circumferentially that turn compressing a resilient tube. The invention establishes a peristaltic pump configuration whereas the roller slidingly engages a recess in rotor, hereinafter referred to as a "step," causing occluding of the resilient tube inducing a fluid flow therein. Distinctively, the invention uses a cylindrical type member, hereinafter referred to as a "roller," uniquely traveling over a resilient tube causing compression forcing liquid through the tube. To augment the utilization of the roller, the rotor body step allows the roller to both freely rotate and maintain squeezing pressure along the resilient tube. So as a powering means causes the rotor to rotate, the roller moves along the resilient tube with the resilient tube undergoing both compression and returning to its original state as with resilient tubes with all types of peristaltic pumps.

There is an abundance of commercially available peristaltic pump types. The majority of these peristaltic pumps are complicated and require many parts working in combination to facilitate pumping in comparison to the invention being disclosed.

Unlike the invention, the prior art does not incorporate a free rolling roller that during rotor rotation wedges against the inclination of the rotor step subsequently squeezing against the resilient tube. An example of a current roller peristaltic pump is shown in U.S. Pat. No. 6,494,692 to Green. The Green peristaltic pump incorporates fixed rollers to facilitate flow through a resilient tube.

Another example similar of a conventional roller peristaltic pump is shown in U.S. Pat. No. 7,478,999 to Limoges. The Limoges peristaltic pump again incorporates fixed rollers to facilitate flow through a resilient tube. Just as the Green patent, Limoges does not incorporate the abovementioned features of the invention and requires numerous parts to facilitate flow through a resilient tube.

BRIEF SUMMARY OF THE INVENTION

The present invention comprises a peristaltic pump structure having a pump housing that provides a channel to locate a resilient tube and bore for a rotor. The rotating rotor has one or more rollers. The roller slidingly engages with the rotor causing consistent squeezing force into a resilient tube. The friction of the roller against the resilient tube causes the roller to index into the rotor step all the while allowing the roller to rotate resulting in a consistent rotational force and resultant squeezing of the resilient tube. As with all roller pumps, this squeezing pressure against the resilient tube facilitates the pumping of a liquid or gas. Unlike existing roller pumps, the roller pressure is self-regulating and excessive force against the resilient tube does not come into play. The object of the invention is to provide a peristaltic pump that has good performance, simple construction, low cost and maintenance, and long service life of a resilient tube.

In the illustrative embodiment, the pump housing provides both the bearing support for the rotor and channel for the resilient tube to facilitate peristaltic pumping operation.

In another illustrative embodiment, the rotor step with the roller's cam feature increases the effect of the roller's squeezing the resilient tube.

In a further illustrative embodiment, the rotor, rollers, pump housing and the resilient tube work collectively to facilitate peristaltic pumping.

In accordance with a preferred embodiment hereafter described, a peristaltic pump shown having dual rollers utilizes the features of the invention.

As will be understood from the following specification, the pump of the present invention can be scaled to various capacities with pump components being constructed using materials or combination of materials including a hard dense plastic such as UHMWPE (Ultra-high-molecular-weight-polyethylene), PTFE (Polytetrafluoroethylene), composites, and/or metals.

These and other features and advantages of the invention will become apparent from the detailed description below, in light of the accompanying drawings.

BRIEF DESCRIPTION OF THE DRAWINGS

For purposes of clarity and brevity, like elements and components will bear the same designations and numbering throughout the Figures.

DETAILED DESCRIPTION OF THE INVENTION

Figure 1:
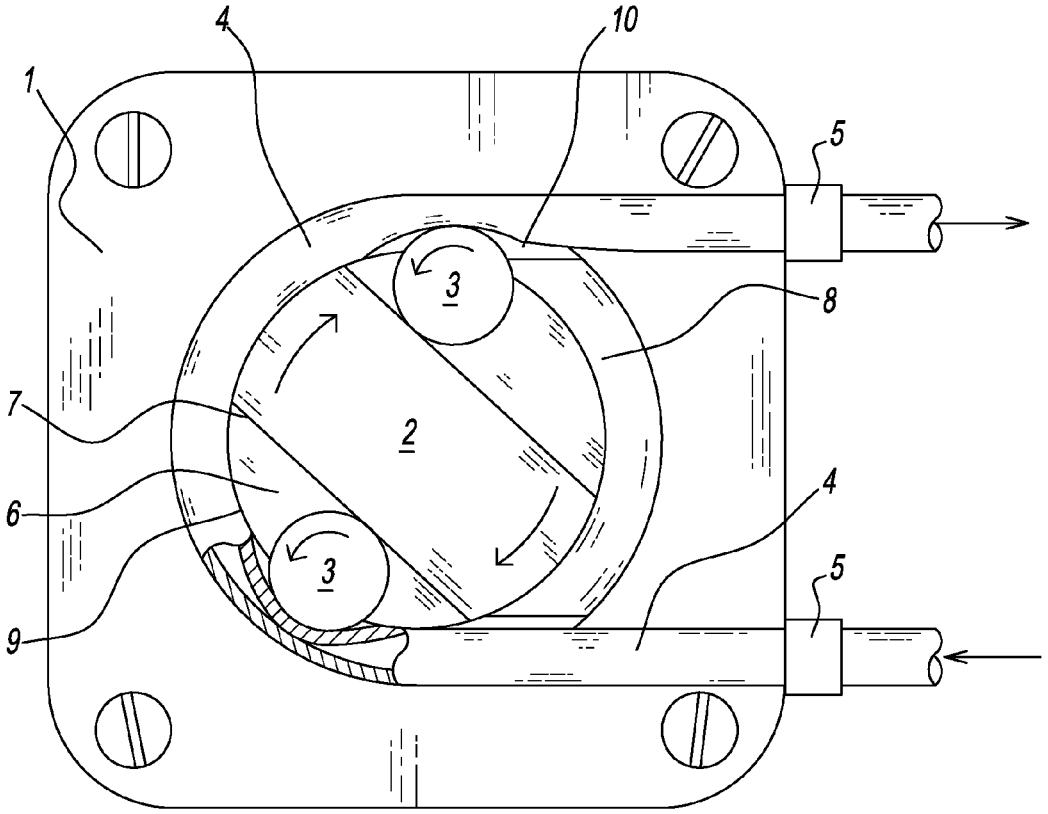
FIG. 1 is a perspective view of the peristaltic pump embodying the invention with the roller slidingly engaging the rotor compressing the resilient tube.

Referring to FIG. 1, illustrated is a perspective view of the peristaltic pump housing (1) with the centrically mounted rotor (2) having a slidingly engaging roller (3) compressing the resilient tube (4). A housing cover plate closes the pump housing when all parts described are installed. Prototypes for practical purposes have used an acrylic window cover plate allowing viewing of the pump during operation. For pump expeditious serviceability, a hinged cover plate may be advantageous but must safely secure and be sturdy enough to prevent lateral travel of the roller(s). Pump housing (1) is provided with a channel (10) that allows positioning of a resilient tube (4). With the rotor (2) rotating clockwise, flow is indicated by the arrows. By changing rotor (2) rotation the flow can be reversed without deterring pump performance. Shown are the resilient tube locking clips (5) or the equivalent to maintain position of resilient tube (4) in the housing channel (10). Also, it is understood that a motor (not shown) is connected to the rotor.

Cylindrical body rotor (2) rotates on a fixed axis with respect to the geometric center of the pump housing bore (9). Rotor (2) has steps (6) on which cylindrical rollers (3) freely slide. When the rotor (2) rotates, each roller (3) is slidingly held in the rotor step (6) against the step's riser (7) thereby frictional force generated by the roller (3) rotating against the resilient tube (4). Squeezing of the resilient tube results in delivering liquid or compressed gases as indicated by the direction of the arrows. A filler piece or spacer tube is indicated by (8) fills the void of the resilient tube channel (10) in the pump housing (1) to maintain the roller (3) position. The "void" is created by the absence of a resilient tube (4) in the channel (10) because of the resilient tube (4) approximating the u-shape position in and out of the pump housing (1). For a single roller pump, the spacer tube (8) feature would not be required since the roller (3) would always be in contact with a section of the overlapping loop of resilient tube (4) in the pump housing channel (10).

Peristaltic pump operation of the types having rollers affixed to the roller is well documented. However, since the invention employs a roller differently, mainly being the roller (3) is not permanently attached to the rotor (2), an explanation must be given how the roller (3) independently causes the squeezing of the resilient tube (4). Most importantly, if a pump using two or more rollers is configured, then the filler or spacer tube (8) must be used to maintain tracking of the roller (3). The step (6) in the rotor (2) maintains roller (3) position throughout the compression and squeezing of the resilient tube (4) and on the rotor (2) revolution point when the roller (3) is not in direct contact with the resilient tube (4) it maintains its position therewith the spacer tube (8). The spacer tube (8) should be identical to the resilient tube (4) used in the pump. The roller (3) travels along the spacer tube (8) during rotor revolution. The spacer tube (8) keeps the roller (3) from falling out of the roller step (6) path and subsequently dislodging inside the pump housing during the rotor (2) rotation and/or when the pump motor is off. Moreover, the spacer tube (8) is to prevent the "free" rollers (3) of becoming dislodged from the rotor step (6) into the circumferential channel (10) provided for the resilient tube (4). Furthermore, the spacer tube (8) allows the rollers (3) to continue gradually and consistently during rotation thus increasing tubing (4) life and reducing pulsations. A motor or any other suitable drive means causes the rotor (2) rotation (not shown).

The friction of the roller against the resilient tube (4) causes the roller (3) to both rotate and slide in the rotor step (6) effecting a wedge or cam action providing pressure on the resilient tube (4). The roller (3) pressure is limited to the point of full compression of the resilient tube (4) due to the respective friction of the materials used in construction. With other peristaltic roller type pumps excessive pressure causes premature wear of the resilient tube. The invention's roller (3) pressure on the resilient tube (4) is delivered consistently but not excessively throughout the rotor (2) revolution onto the occluding resilient tube (4). This is possible by attribution of material selection to the pump assembly. For example, pump housing (1) made of UHMWPE (Ultra-high-molecular-weight-polyethylene), a rotor (2) made of mechanical grade PTFE (Polytetrafluoroethylene), a roller (3) made from Nylon 66, and a high temperature fluoroelastomer soft resilient tube (4) will create the above-mentioned material selection for working conditions. In addition the bearing surfaces of the UHMWPE pump housing (1) and the PTFE rotors (2) are ideal for low rpm and inexpensive material and manufacturing cost. In other words, in an all plastic pump, the rotor (2) would be the wearing component therefore made of softer material than the pump housing (1). If plastics having bearing qualities such as UHMWPE are used in the pump housing (1) construction this may be satisfactory for the rotor bearing surface. The rotor (2) bearing surface could be upgraded with bearings ranging from bronze bearings or standard ball or roller bearings for the rotor (2). Alternately a shaft affixed to a rotor (2) embodiment could be supplied with the bushing and bearing. In the all plastic economical pump embodiment, utilizing multiple rollers (3) and the spacer tube (8) are recommended. These components keep the rotor (2) stable in its rotation and prevents the softer construction material of the rotor (2) from premature wear of its outside diameter bearing surfaces with the pump housing bore (9) in the pump housing body (1). The spacer tube (8) and incorporating multiple rollers (3) allow consistent wear of the rotor (2) bearing surfaces because of even distribution of the roller (3) pressure exerted back into the rotor step riser (7) and consequently the body of the rotor (2). By preventing rocking movement of the rotor (2) during rotation, premature wear of the both the rotor (2) and rotor step riser (7) bearing surfaces is avoided.

With respect to pump maintenance, when the resilient tube (4) is replaced it is advisable to also replace the rollers (3). Changeout of the resilient tube (4) is extraordinarily simple as compared to other peristaltic pumps. Simply remove the front cover; pull out the worn tube (4), the rollers (3) will easily come away, and position the new resilient tube (4) and rollers (3). The easiest method is to install the rollers (3) is as follows. In hand, work the roller (3) against the resilient tube (4) while inserting the roller (3) at the widest part of the rotor step (6) and finally, replace the housing cover plate. The spacer tube (8) should be replaced during the replacement of the resilient tube (4).

Figure 2:
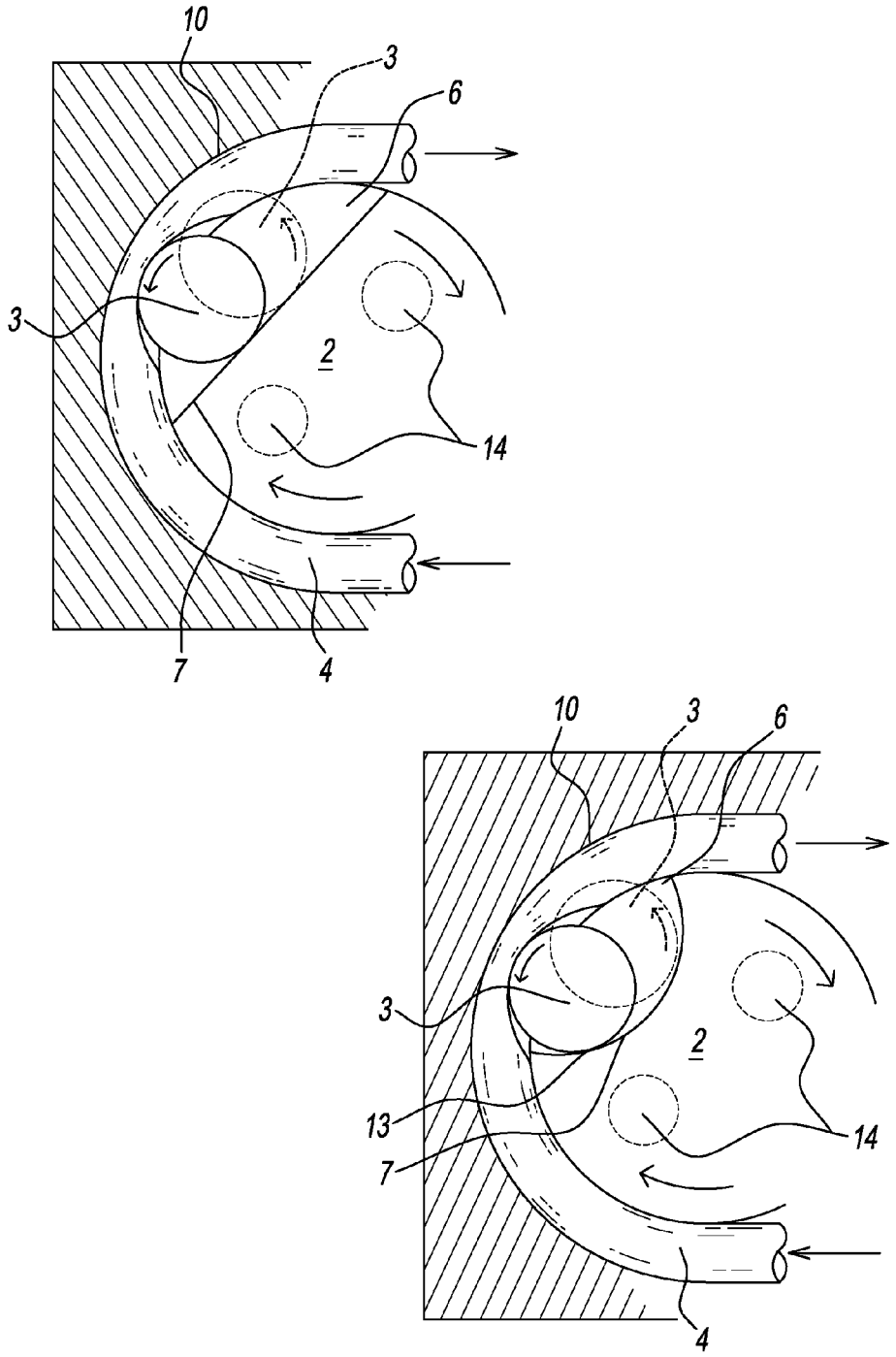
FIG. 2 is a partial cut-away view showing the rotor and roller position and subsequent compression of the resilient tube and an embodiment of the rotor step.

FIG. 2 is illustrates a partial cut-away view showing the rotor (2) and roller (3) position and subsequent compression of the resilient tube (4). A description of the peristaltic pump operation now will be given. The pump rotor (2) is rotating clockwise with the roller (3) indexing in the rotor step (6) slidingly engaging the rotor riser (7) protruding into and thereby compressing the resilient tube (4) that is held in place in the resilient tube channel (10). The flow from the resilient tube (4) is indicated by the arrows. As a result of the occluding and frictional forces with the resilient tube (4), the roller (3) wedges itself between the rotor riser (7) and the resilient tube (4) at or near total compression. Moreover, due to the frictional forces of the roller (3) with the resilient tube (4) and the less frictional surfaces of the roller (3) with the rotor riser (7) and plastic lubricating qualities, the roller (3) rotating action results simultaneously. The roller (3), shown rotating counter clockwise, as a result of these forces is held in place as it travels along the resilient tube (4) to effect pumping. Also illustrated is an embodiment of the rotor (2) having an arch feature (13) providing a cam profile and mechanical advantage to the roller (3). The invention is not limited as to the shape of the step (6) and riser (7). In an all plastic pump, the rotor (2) could be the wearing component therefore made of softer material than the pump housing (1). With the softer plastic materials such as PTFE, the difficulty of coupling to a motor (not shown) is overcome by providing the rotor drive holes (14). The holes (14) allow for push fit insertion of pins that are used to create the means for connecting to commercially available motor couplings.

Figure 3:
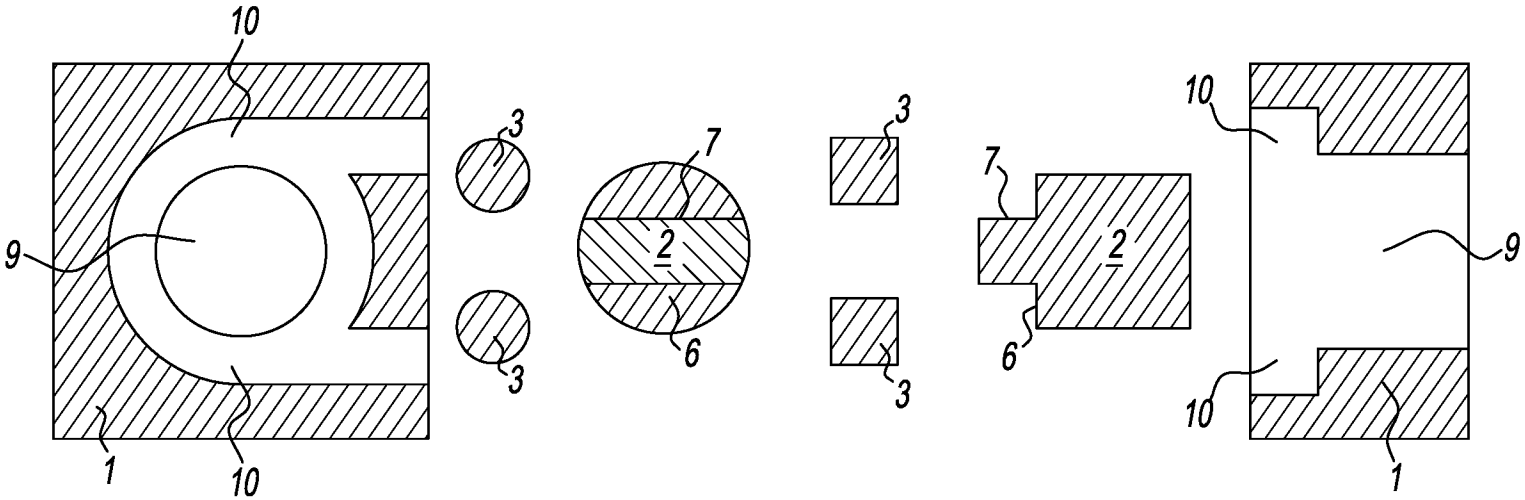
FIG. 3 is front and side sectional views of the pump working members.

In FIG. 3 illustrates a dual roller (3) peristaltic pump embodiment of the invention. Shown from left to right are front and side sectional views of the pump working members. The pump housing (1) is shown with resilient tube channel (10) for placement of the resilient tube. The rollers (3) and the rotor (2) are shown with its step (6) and riser (7). Note the pump housing bore (9) accommodates the outside diameter of the rotor (2). The pump housing bore (9) could have a bushing placed therein to provide a metal rotor (2) support. In the abovementioned combination of plastics were used for the rotor (2) and pump housing (1), then the bushing would not be required. This would be for the economical version of the pump. As seen on the right-hand side of the drawing figure, the rotor (3) length, including step (6) and riser (7) should approximate the length of the pump housing bore (9).

Figure 4A:
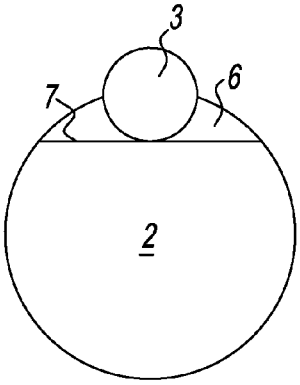
FIGS. 4A-D are front plan views of alternate rotor and roller embodiments.
Figure 4B:
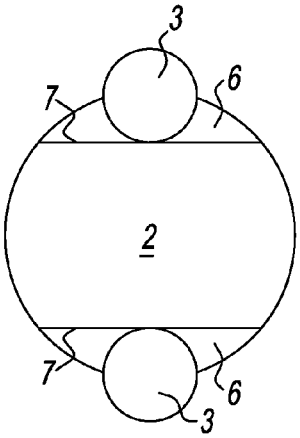
Figure 4C:
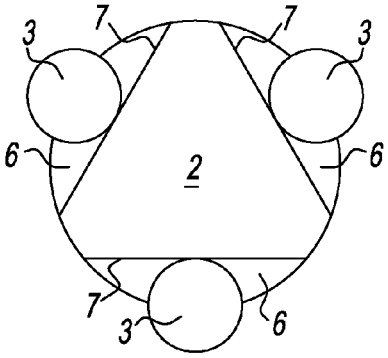
Figure 4D:
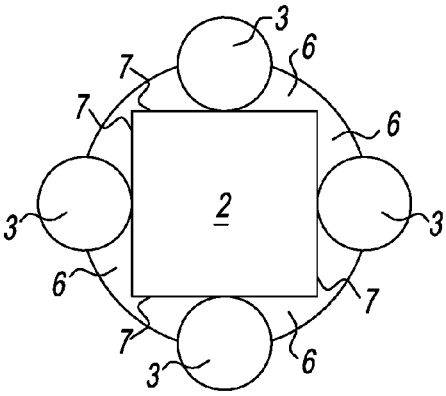

FIGS. 4A-D illustrate invention's rotor (2) adapted to single roller (3), dual rollers (3), triple rollers (3) and quad roller (3) configurations. Shown throughout the figures are the rotor step (6) and step's riser (7). The invention is adaptable to a variety of roller (3) configurations dependent upon requirements of volume and flow characteristics. For example, FIG. 4A shows the invention embodiment known as a 360° peristaltic pump configuration whereas a single roller (3) compresses a resilient tube all the time during every revolution. More commonly, two rollers (3) will be used to incorporate the features of the invention, shown in FIG. 4B. FIGS. 4C-D illustrate three and four roller (3) pump configurations that dependent upon fluid to be pumped may be desirable for smoother flow, i.e. fewer pulsations than a single or dual roller (3) pump. FIGS. 4A-D use the rotor to provide both a rotational bearing surface and a step to manipulate the rollers (3) to squeeze the resilient tube.

FIG. 4A shows the invention's simplest configuration, the adaption to a single roller (3) and single step (6) in the rotor (2). The rotor (2) assembly has just two moving parts being the rotor (2) and the roller (3). If a light duty application was desired then the rotor and housing could be made from plastics that would be compatible as bearing surfaces. Otherwise, the housing bore for the rotor (2) could be fitted with a bushing or bearing coming in contact with a metal rotor, e.g. type 316 stainless steel. The roller (3) can be made from a variety of plastics such as Nylon 6/6 and metals.

Within the scope of the invention, a traditional peristaltic pump design of having a shaft driving a rotor with bearing fitted to the shaft is possible. However, this rotor (2) would have a member tantamount to a rotor step (6) and riser (7) slidingly engaging with the roller (3). For the purposes recited, the member is considered the same contrivance.

An exemplary peristaltic pump of the present invention has a rotor member embodiment described. The riser (7) is preferably parallel to the diameter of the rotor (2) and provides ample bearing surfaces for the roller (3). The width of the step (6) is measured perpendicular from the riser (7) and at the widest point of its radius. The step (6) width provides protrusion into the resilient tube correlating the resilient tube inside diameter and its wall thickness. For example, a roller (3) one-half inch diameter (12.7 mm) and a nominal one-quarter inch (6.35 mm) resilient tube having a wall thickness of one-sixteenth inch (1.6 mm) and an inside diameter of one-eighth inch (3.18 mm) should have should have a rotor step (6) approximately five-sixteenth inch (7.94 mm). The varying perpendicular length of the rotor step (6) will accommodate minor differences in resilient tubing inside and outside diameters because of the rotating roller (3) slidingly traveling in the rotor step (6) while pressing against the resilient tube. The depth or rise of the rotor step (6) should approximate the height of the roller (3). The roller (3) height dimension is calculated based upon the fully compressed resilient tube dimension. The following figure illustrates the invention variations of rotor and roller arrangements and embodiments of the invention.

Figure 5:
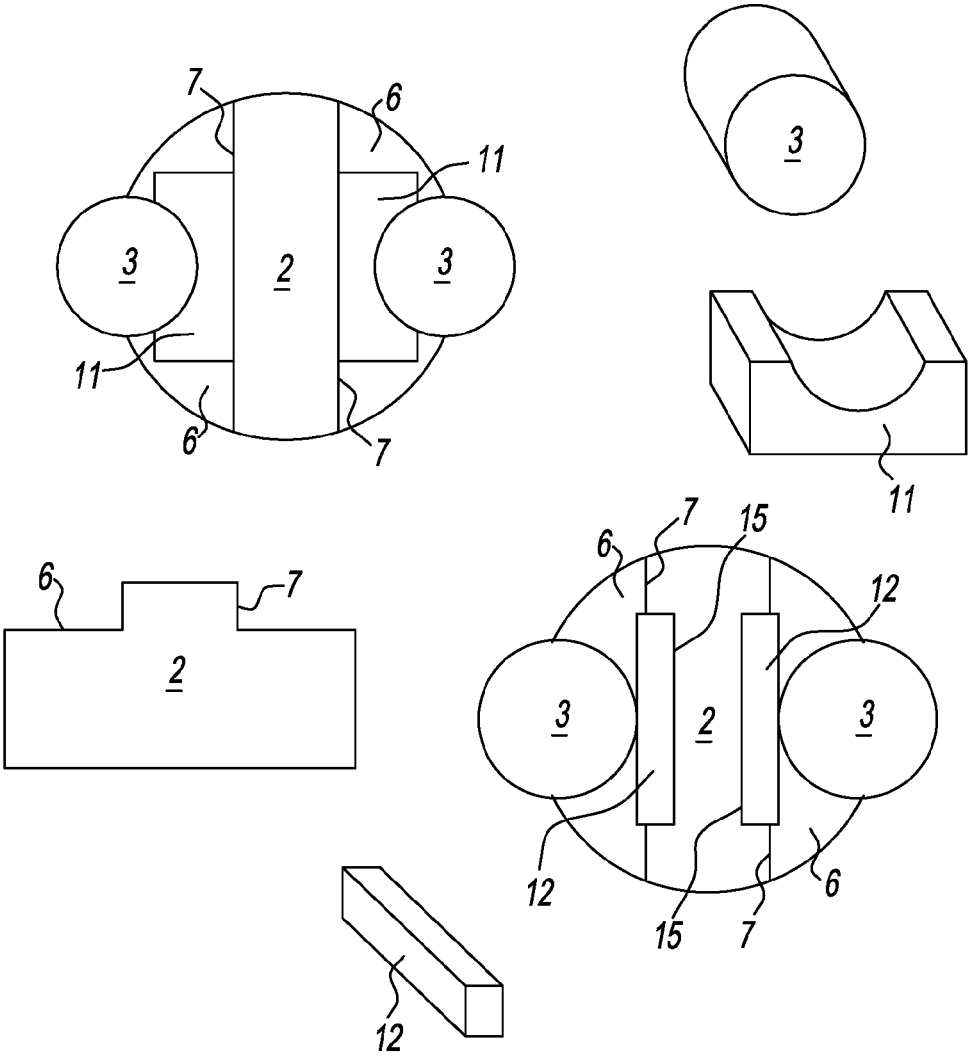
FIG. 5 is a combination of plan and isometric views of rotor and roller wear compensating members.

FIG. 5 illustrates optional features of the invention pertaining to assisting the roller (3) rotation and sliding along the rotor step (6) and its riser (7) in particular to using a metal rotor (2). Referring to the rotor step (6) and its riser (7), if a metal rotor (2) was used, a wear strip (12) comprised of a material having lubricating qualities such as a UHMWPE could be affixed against the step's riser (7) making contact with the roller (3). As illustrated, a pocket (15) in the rotor riser (7) allows the wear strip (12) to be held in place from the occluding back pressure of the resilient tube to the roller (3) and finally on the wear strip (12). The wear strip (12) embodiment can also be incorporated as an upgrade to an economical version of the pump using an inexpensive rotor (2) of PTFE with the wear strip made of same material. As an additional benefit, this would increase the life of the rotor (2). During routine maintenance, a new wear strip (12) can easily be inserted in the pocket (15). The wear strip (12) can be made from a variety of materials with varying thickness to adjust to the type and diameters of resilient tubes employed with the pump.

Another embodiment is incorporating a sliding roller block (11) for a roller (3) that during rotor (2) rotation would slidingly engage the resilient tube similar as the existing roller without said block. The sliding roller block (11) is made from a rectangular piece with a midsection radius to accommodate the roller (3). Once again a material with lubricity is used that allows the sliding roller block (11) to slide in the step (6) against the riser (7) and allow the roller (3) to rotate. These embodiments are considered in relation to the materials of construction including the type of resilient tube whereas a wear strip or block would be conducive to pump operation. An example thereof using a either a wear strip (12) or sliding roller block (11) constructed from UHMWPE with both a metal rotor (2) and roller (3) squeezing against the harder durometer grades of plastic tubes used in peristaltic pumps referred to in this specification as a "resilient tube."

Figure 6:
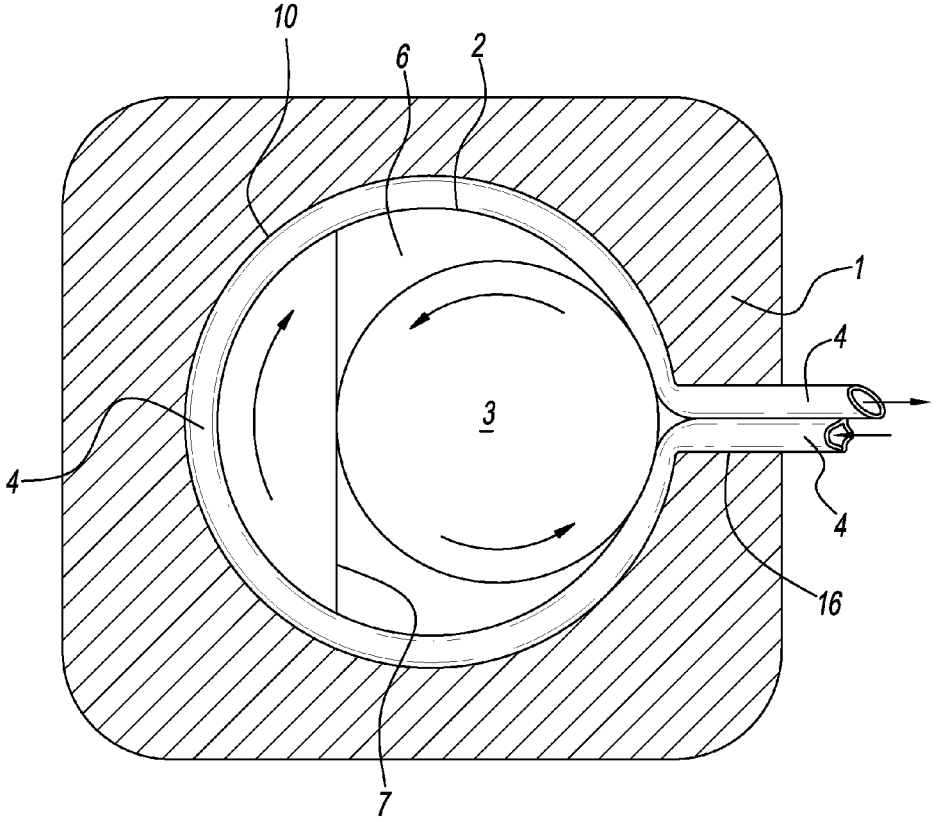
FIG. 6 is a front view of a single roller embodiment of the invention.

FIG. 6 shows a single oversized roller (3) compressing the resilient tube (4). Single roller peristaltic tube pumps are commonly referred to as 360° pumps. Unlike the invention embodiment shown in FIG. 6, state-of-the-art single roller peristaltic pumps use an overlapping resilient tube to regulate the fluid being pumped and use an undersized roller in scale comparison. Shown is the pump housing (1) having the resilient tube channel (10) being circular and having a single path (16) provided in the pump housing (1) to allow the placement of the resilient tube (4). Shown are the rotor (2), roller (3) with directional movement indicated and the resilient tube (4) entering and exiting the pump housing (1) with pumped flow direction indicated. The rotor (2) is shown with its step (6) and riser (7) components.

Several benefits are derived from this embodiment, the first being pump efficiency is increased. Since the resilient tube channel (10) does not have to incorporate an overlapping resilient tube (4), therefore roller (3) contact with the resilient tube (4) primarily facilitates pumping and not extra tube length dedicated to regulating the flow as typical 360° pumps. Another benefit is that depending upon the outside diameter of the roller and pump rotor RPM (revolutions per minute) flow pulsation can be decreased because of the gradual rocking squeezing pumping action as a result utilizing a substantially larger roller which gently cuts off the flow on the beginning of a new pumping cycle which must occur to prevent backflow. Still, another benefit of the pump embodiment utilizing the oversized roller (3) and pump housing channel (10) configuration as described is the ability to change roller size to accommodate different diameters of tubing. The oversized roller (3) in comparison to the existing art will have a diameter substantially greater. For example, one working prototype compressing a one-quarter inch (6.35 mm) diameter resilient tube (4) has a roller (3) 56% of the pump housing channel (10) diameter. The pump housing channel (10) diameter is two inches (50.8 mm) and has a roller one and one-eighth inch (28.6 mm) diameter. Design factors such as the size and type of resilient tubing and pump housing channel (10) diameter and the sizing of the oversized roller (3) varies in relation to other pump sizes such as large industrial peristaltic pumps. Generally, the oversize roller (3) is greater than standard practice and its outside diameter is calculated to maintain the technical advantage of utilizing the pump housing channel (10) with single path (16) provided in the pump housing (1) to allow the placement of the resilient tube (4) as illustrated. Specifically, it is understood the definition of the term "oversized roller" is a roller (3) having the outside diameter large enough to simultaneously fully compress the incoming and exiting flow section of the resilient tube (4) positioned in the pump housing channel (10) through the single path (16), as illustrated in FIG. 6. Most importantly, the oversized single roller (3) and single path (16) invention is definitely applicable to other conventional peristaltic pumps not employing the invention's slidingly engaged roller and pump embodiment but using standard practices connecting the roller (3) to rotational means.

The invention's utilization of an oversize roller (3) and single path (16) in comparison to existing single roller pumps is that it allows the means of positioning the resilient tube (4) as to maximize roller pumping contacting therewith. Virtually all of the resilient tube (4) is pumped with no overlapping tubing sections such as existing 360° peristaltic pumps having a crossover loop. This loop constitutes sections of the tube used to overlap the inlet and out flows to guarantee temporarily shutting off the pumped flow to prevent loss of pressure and/or backflow during the continuous rotor rotation with a roller occluding the resilient tube. Best results have been found incorporating the single path (16) positioned at the parallel to the rotor diameter, as illustrated. In FIG. 6, the inlet and outlet sections of the resilient tube are situated in tandem together in the pump housing (1) with its single path (16) as described that not only accommodates the resilient tube (4) positioning for flow regulating purposes but remarkably negates or alleviates the dependence of retaining clips, stops, and various fittings. Dependent upon rotor (2) RPM, the resilient tube (4) remains stationary in the housing channel (10) provided for the resilient tube (4) unlike other peristaltic pumps requiring provisions of preventing repositioning of the resilient tube (4). Conventional peristaltic pumps, as a side effect of a resilient tube (4) being manipulated by a roller, must have means to secure the resilient tube from feeding itself through and out of a tubing channel. Other benefits of this embodiment are the potential usage of an increased variety of compressible tubes for peristaltic usage with disregard to means of securing the tube and the expedient changeout of a worn resilient tube and longer tubing life, less maintenance, and ease of maintenance when required. The oversized "free" roller (3) is easy to physically handle during changeout of the resilient tube (4); with a little thumb pressure—it simply pops out and pops back into place. The 360° the embodiment of the invention is easily adaptable to a variety of peristaltic pump applications. The phenomenon of having the resilient tube (4) retaining its position on the pump channel (10) is also attributed to the resilient tube (4) slightly compressed state and mutual surface contact and resultant staying of the resilient tube (4) as it rests in the single path (16) as shown. If flow pulsation is the operator's primary concern, it has been found that the larger the roller (3) is incorporated, the less pulsation occurs albeit a cost of increased friction with the resilient tube (4) and most likely with the pump operating at slower RPM's than a pump configured with an oversized roller (3) having less circumference operating at higher RPM and flows (this roller in particular is still considered as oversized in comparison to the existing art). However, this condition is irrelevant in many applications due to the increased efficiency of the 360° pump embodiment.

It will finally be understood that the disclosed embodiments represent presently preferred forms of the invention, but are intended to be explanatory rather than limiting of the invention. Reasonable variation and modification of the invention as disclosed in the foregoing disclosure and drawings are possible without departing from the scope of invention. The scope of the invention is defined by the following claims.

What is claimed:

1. A peristaltic pump comprising:

a pump housing having an inner cylindrical surface;

a rotor having an outer cylindrical surface, the rotor being rotatably and concentrically mounted within the pump housing;

a resilient tube mounted between the pump housing inner cylindrical surface and the rotor outer cylindrical surface;

the rotor having at least one step formed in the outer cylindrical surface of the rotor, each at least one step having a flat riser surface; each flat riser surface completely extending across the rotor to intersect the rotor outer cylindrical surface at two points; and, at least one roller having a cylindrical form, each of the at least one rollers being located within a corresponding at least one step of the rotor, each roller being engaged with the corresponding flat riser surface to facilitate both protrusion of the roller against the resilient tube and rotational movement along the flat riser surface resulting from frictional contact with the resilient tube, each roller squeezing against the resilient tube to provide peristaltic pumping.

* * * * *